US005729239A

United States Patent [19]

Rao

[11] Patent Number: 5,729,239

[45] Date of Patent: Mar. 17, 1998

[54] VOLTAGE CONTROLLED FERROELECTRIC LENS PHASED ARRAY

[75] Inventor: Jaganmohan B. L. Rao, College Park, Md.

[73] Assignee: The United States of America as represented by the Secretary of the Navy, Washington, D.C.

[21] Appl. No.: 521,847

[22] Filed: Aug. 31, 1995

[51] Int. Cl.[6] ..... H01Q 19/06

[52] U.S. Cl. ..... 343/753; 343/754; 343/757

[58] Field of Search ..... 343/753, 754, 343/755, 757; 342/374, 376

[56] References Cited

U.S. PATENT DOCUMENTS

| | | | |
|---|---|---|---|
| 3,276,023 | 9/1966 | Dorne et al. | 343/754 |
| 3,354,469 | 11/1967 | Kelleher | 343/754 |
| 3,708,796 | 1/1973 | Gilbert | 343/754 |
| 4,090,204 | 5/1978 | Farhat | 343/754 |
| 4,297,708 | 10/1981 | Vidal | 343/754 |
| 4,323,901 | 4/1982 | De Wames et al. | 343/754 |
| 4,509,055 | 4/1985 | Fassett | 343/754 |
| 4,588,994 | 5/1986 | Tang et al. | 343/754 |
| 4,636,799 | 1/1987 | Kubick | 343/753 |
| 4,706,094 | 11/1987 | Kubick | 343/753 |
| 4,809,011 | 2/1989 | Kunz | 343/754 |
| 4,975,721 | 12/1990 | Chen | 343/754 |
| 5,309,166 | 5/1994 | Collier et al. | 343/754 |

OTHER PUBLICATIONS

Richard H. Park, *Radant Lens: Alternative to Expensive Phased Arrays*, Microwave Journal, Sep. 1981, pp. 101–105.

V.k. Varadan, D.K. Ghodgaonkar, V.V. Varadan, J.F. Kelly and P. Glikerdas, *Ceramic Phase Shifters for Electronically Steerable Antenna Systems*, Microwave Journal, Jan. 1992, pp. 116–127.

C. Chekroun, D. Herrick, Y. Michel, R. Pauchard and P. Vidal, *Radant: New Method of Electronic Scanning*, Microwave Journal, Feb. 1981, pp. 45–53.

*Primary Examiner*—Donald T. Hajec
*Assistant Examiner*—Tan Ho
*Attorney, Agent, or Firm*—Thomas E. McDonnell

[57] ABSTRACT

A device for scanning in a scanning axis includes a periodic array of conductive plates disposed along the scanning axis. The device has a periodic array of ferroelectric material slabs disposed along the scanning axis, each slab being disposed between a pair of adjacent conductive plates, adjacent slabs being separated by one of conductive plates. Each of the slabs has a receiving face and a radiating face substantially parallel to each other. Input transmission means feed an input electromagnetic signal to the periodic array of slabs in a propagation direction so that the input electromagnetic signal is incident on the receiving faces of the slabs and so that the electrical component of the input electromagnetic signal received at each receiving face has a component parallel to the scanning axis. Output transmission means for transmitting an output signal from the slabs responsive to the electromagnetic signal transmitted from each receiving face in the corresponding slab and received at the corresponding radiating face. The device includes a plurality of means for selectively applying a voltage across each of pairs of conductive plates disposed about a slab so as to selectively control the phase of the electromagnetic signal received at each of the radiating faces having been transmitted from the receiving face in the corresponding slab.

4 Claims, 6 Drawing Sheets

VOLTAGE CONTROLLED FERROELECTRIC LENS PHASED ARRAY

FIELD OF THE INVENTION

This invention relates generally to electronically scanned antennas, and more particularly to electronically scanned phased array antennas using ferroelectric material.

BACKGROUND OF THE INVENTION

Phased array antennas can steer transmitted or received signals by electronic scanning means without mechanically rotating the antenna. Phased array scanning lens antennas for use in azimuthal and elevational (three-dimensional) scanning typically include n×m elements, each element including a receiving antenna, a radiating antenna, and an individual ferrite or diode phase shifter for transmitting the signal from the receiving antenna to the radiating antenna and selectively adjusting the phase of the signal transmitted from the receiving antenna to the radiating antenna. The radiating antenna outputs an electromagnetic signal. Control circuitry adjusts the relative phase of the signal in the individual elements with respect to each other so as to selectively control the direction of propagation of the signal transmitted from the phased array antenna.

A typical electronically scanned phased array antenna for three-dimensional scanning in radar applications with 1° pencil beam will have radiating elements spaced every half-wavelength, 100 elements in each column and 100 elements in each row for a total of 100×100=10,000 elements. Such a phased array is costly for several reasons. Ferrite and diode phase shifters are costly. Because of the configuration of such systems, they use complex beam steering controls. Because each element has an independent phaseshifter, the cost of such a system goes up as the product of the number of rows and columns (n×m), 10,000 in this example. Other types of phased array antennas using constrained feed configurations typically use elaborate and costly feeds for providing the appropriate input signal to each receiving element.

SUMMARY OF THE INVENTION

It is an object of this invention to provide a low cost, simple electronically scanned phased array antenna.

It is another object of this invention to provide a low cost, simple electronically scanned phased array antenna using a configuration reducing the number of phase shifting devices.

It is another object of this invention to provide a low cost, simple electronically scanned phased array antenna using simple phase shifting devices.

It is another object of this invention to provide a low cost, simple electronically scanned phased array antenna using bulk phase shifters.

It is a further object of this invention to provide a low cost, simple electronically scanned phased array antenna using simple steering control.

It is a further object of this invention to provide a low cost, simple electronically scanned phased array antenna using simple feed.

The above objects can be accomplished by a device for scanning in a scanning axis in a scanning plane which includes a periodic array of conductive plates disposed along the scanning axis, each conductive plate being substantially rectangular and substantially perpendicular to the scanning axis, adjacent plates being disposed about half a wavelength apart. The device has a periodic array of slabs disposed along the scanning axis, each slab comprising ferroelectric material, being disposed between a pair of adjacent conductive plates of the periodic array of conductive plates, adjacent slabs being separated by one of the conductive plates. Each of the slabs has a receiving face and a radiating faces substantially parallel to each other. Each of the slabs is for transmission of an electromagnetic signal from the receiving face to the radiating face responsive to an electromagnetic signal received at the receiving face. Each of the radiating faces, scanning plane, and the conductive plates are substantially mutually perpendicular. Input transmission means feed an input electromagnetic signal to the periodic array of slabs in a propagation direction so that the input electromagnetic signal is incident on the receiving faces of each of the slabs and so that the electrical component of the input electromagnetic signal received at each receiving face has a component parallel to the scanning axis. Output transmission means transmit an output signal from the periodic array of slabs responsive to the electromagnetic signal transmitted from each receiving face in the corresponding slab and received at the corresponding radiating face. The device also includes a plurality of means for selectively applying a voltage across each of said pairs of conductive plates disposed about a slab so as to selectively control the phase of the electromagnetic signal received at each of the radiating faces having been transmitted from the receiving face in the corresponding slab.

Two of the above such devices can be cascade connected with a polarization twist layer to provide 3-dimensional scanning.

These and other objects, features and advantages of the present invention are described in or apparent from the following detailed description of preferred embodiments.

BRIEF DESCRIPTION OF THE DRAWINGS

The invention will be described with reference to the drawings, in which like elements have been denoted throughout by like reference numerals, and wherein.

DETAILED DESCRIPTION OF THE INVENTION

Figure 1:
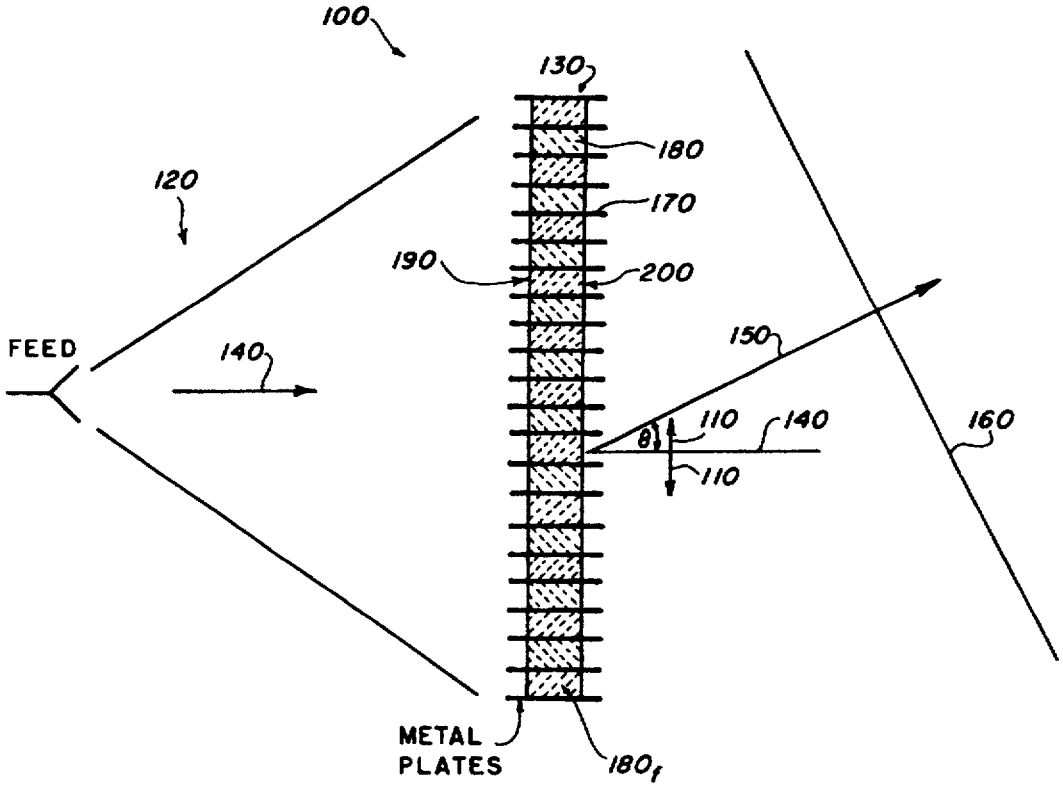
FIG. 1 is a cross-sectional view in the scanning plane of a device for two-dimensional scanning in a scanning plane.

Referring now to the drawings, FIG. 1 shows a device 100 for two-dimensional scanning in a scanning axis 110 in a scanning plane represented as the two-dimensional plane of the drawing. The device 100 includes a feed system 120 for feeding an input electromagnetic signal to a lens 130 in a propagation direction 140. The input electromagnetic signal is shown as having a cylindrical wavefront, but the invention is not so limited, especially for use in three-dimensional scanning. The feed system 120 is a space feed system which uses a simple line source feed, thereby reducing the cost and complexity of the system 100. Other types of feed systems 120, such as those providing spherical or planar wavefronts may be used as appropriate.

The lens 130 responsive to the electromagnetic signal received from the feed system 120 with propagation direction 140 transmits an output signal in propagation direction 150 with equal-phase wavefront 160. Although so depicted, the output signal transmitted by the lens 130 is not necessarily a plane wave. As discussed further below, the projection of the propagation direction 150 in the scanning plane is selectively controlled.

Figure 2:
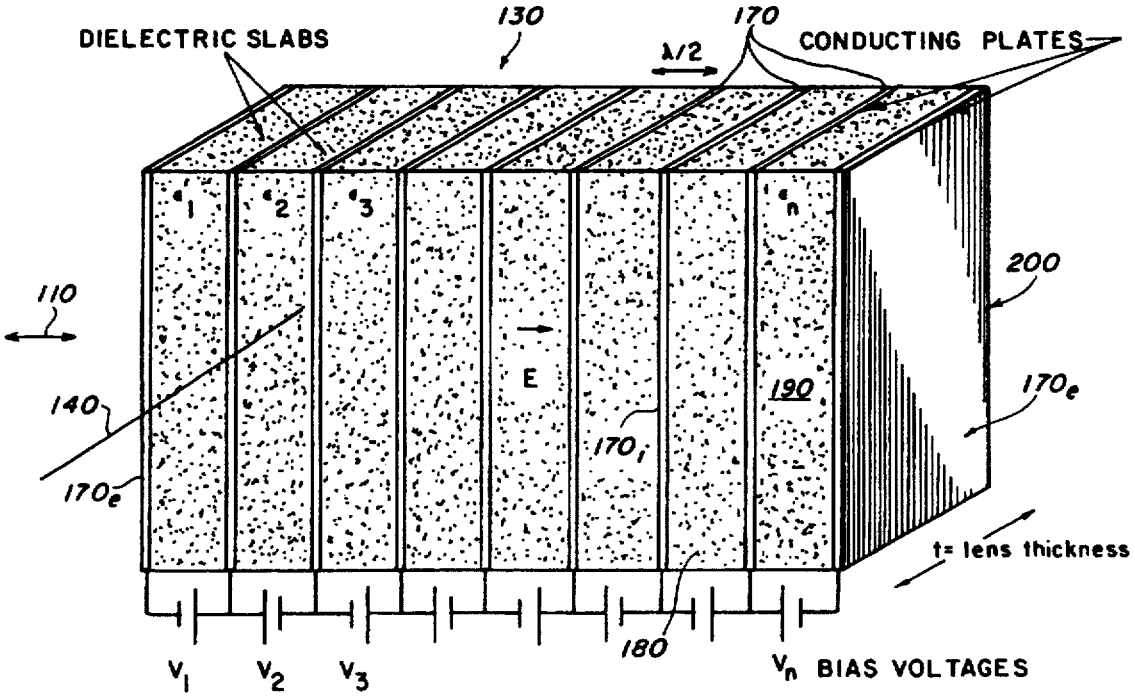
FIG. 2 shows in three-dimensional view the lens of FIG. 1.

Referring now to FIG. 2, the lens 130 of FIG. 1 includes a periodic array of conductive plates 170 disposed along the scanning axis 110, each conductive plate 170 being preferably rectangular and preferably perpendicular to the scanning axis. Adjacent plates 170 are disposed about half a wavelength apart. The distance between adjacent plates 170 will be discussed further below. The periodic array of conductive plates 170 includes a pair (2) of end plates $\mathbf{170}_e$ and a plurality (n−1) of interior plates $\mathbf{170}_i$. The number of conductive plates 170, including the pair of end plates $\mathbf{170}_e$ and the plurality of interior plates $\mathbf{170}_i$ is 2+(n−1)=n+1.

The lens 130 also includes a periodic array of slabs 180 disposed along the scanning axis 110, each slab 180 being at least in part of ferroelectric dielectric material $\mathbf{180}_f$, such as doped barium strontium titanate (BSTO), other ceramics, or composites of BSTO or other ceramics. The dielectric constant $\epsilon$ of the slab 180 can be adjusted by selectively varying a voltage applied across the slab. Each slab is preferably a rectangular solid and is disposed between a pair of adjacent conductive plates 170. A pair of adjacent slabs 180 is separated by an interior plate $\mathbf{170}_i$.

Each slab 180 has parallel receiving and radiating faces 190 and 200, respectively (see FIG. 1). The receiving face 190 is the exposed face shown in FIG. 2; the radiating face 200 is hidden from view in FIG. 2. The slab 180 is for transmitting an electromagnetic signal from the receiving face 190 to the radiating face 200 responsive to an electromagnetic signal received at the receiving face 190. Because of the position of the plates 170, the projection in the scanning plane of the direction of propagation of this signal transmitted from the receiving face 190 to the radiating face 200 is perpendicular to the scanning axis 110. The scanning plane, the conductive plates 170, and the radiating faces 200 are preferably mutually perpendicular. The height of each receiving and radiating face 190 in the direction perpendicular to the scanning axis and perpendicular to the propagation direction 140 is much more than a wavelength and is typically about fifty free-space wavelengths, which is much more than fifty wavelengths of the signal propagating in the ferroelectric material. Hence, the lens 130 functions as an infinite parallel plate medium.

Such an infinite parallel plate medium propagates transverse electromagnetic waves (TEM) from the receiving face 190 to the radiating face 200. The orientation of the electric field does not change as the TEM wave propagates from the receiving face 190 to the radiating face 200. Such an infinite parallel plate medium differs from waveguides of rectangular or circular cross-section in that the latter waveguides do not support the propagation of TEM waves.

As discussed earlier, adjacent plates 170 are preferably disposed about half a wavelength apart. The receiving and radiating faces 190 and 200, respectively, receive and transmit from and to free space and so the wavelength under consideration is the free space wavelength. As known in the art, the spacing may actually be slightly larger (about 10%) and yet still avoid grating lobes, depending on the maximum scanning angle θ (FIG. 1). The spacing between adjacent plates 170 can actually be considerably smaller, even by an order of magnitude, than half a free-space wavelength.

Means known in the art (not shown) are provided for coupling the electromagnetic signal produced by the feed system 120 to the receiving faces 190 so that the electromagnetic signal incident on the receiving face 190 has a component parallel to the scanning axis 110 and for impedance matching the receiving face 190 to free space. For example, as discussed further below, one or more sets of quarter wave transformers can be used. An aperture or additional lens (not shown) can be used as part of the feed system 120 or the coupling means.

A control voltage $V_k$ (k=1,2,3, . . . ,n), preferably dc voltage, applied across the k-th slab selectively controls the relative dielectric constant $\epsilon_k$ since the slab includes ferroelectric material $\mathbf{180}_f$. Control circuitry (not shown) selectively provides appropriate control voltage $V_1, V_2, \ldots, V_n$ across slabs $\mathbf{180}_1, \mathbf{180}_2, \ldots, \mathbf{180}_n$ so as to selectively control the relative phase of the electromagnetic signal incident on the radiating face 200 having been transmitted from the receiving face 190 to the radiating face 200. Thus, the control circuitry creates a phase gradient at the radiating face 200. For a maximum phase change of 2π radians (360°), the thickness of a slab 180 in the propagation direction 140 is $$t = \frac{\lambda_0}{\sqrt{\epsilon_{max}} - \sqrt{\epsilon_{min}}}, \tag{1}$$

where $\epsilon_{max}$ and $\epsilon_{min}$ are the maximum and minimum values, respectively, of the relative dielectric constant $\epsilon$ within the range of voltage $V_k$ under consideration and $\lambda_0$ is the free space wavelength of the electromagnetic radiation under consideration. Assuming typical values $\epsilon_{max}$=100 and $\epsilon_{min}$=81, then $t \approx \lambda_0$. The thickness t of the lens 130 in the propagation direction 140 can be approximately the free space wavelength for the above-stated exemplary values of $\epsilon_{max}$ and $\epsilon_{min}$. For example, at 10 GigaHertz (GHz), the thickness t will be 3 centimeters (cm), which is less than the thickness of a lens array using diodes, for example, as discussed in C. Chekroun et al., "RADANT: New Method of Electronic Scanning," Microwave Journal, pp. 45–53 (February—1981).

The equation for loss in decibels through lens 130 at wavelength $\lambda_0$ is $$L(\mathrm{dB}/\lambda_0) = 27.3\sqrt{\epsilon} \cdot \tan\delta, \tag{2}$$

where tan δ is the loss tangent of the dielectric material. For a loss tangent tan δ=0.005, the lens loss in the X-band is about 1 decibel (dB). The device 100 can equally well be used at other frequencies.

Referring now to FIG. 1, the radiating face 200 of each slab transmits an electromagnetic signal responsive to the electromagnetic signal transmitted from the receiving face 190, propagating through the slab 180 (FIG. 2) and incident on the radiating face 200. By appropriate control of the voltage $V_k$ applied across each slab 180, the lens 130 can selectively output an electromagnetic signal in selectively controlled propagation direction 150. By means known in the art, the control circuitry can readily compensate for a wavefront which is not parallel to the receiving surface 190 and is incident on the lens 130 so as to output a planar wave in selected propagation direction 150 having equal-phase wavefront 160. For example, a cylindrical or spherical wave would not have a wavefront parallel to the receiving surface 190.

As with means for coupling the signal incident on lens 130 to the lens 130, means known in the art (not shown) are also provided for appropriately coupling the electromagnetic signal produced by the radiating face 200 of the array of slabs 180 to free space by proper impedance matching.

The device 100 so described uses a bulk phase shifting lens 130 for scanning in a scanning plane. It uses simple phase shifting devices: ferroelectric slabs 180 sandwiched between conductive plates 170, simple steering control: application of control voltages $V_1, V_2, \ldots, V_n$, and simple feed: space feed. It also provides analog control, unlike diode lens arrays (such as RADANT, previously discussed) which provide digital control.

Figure 3:
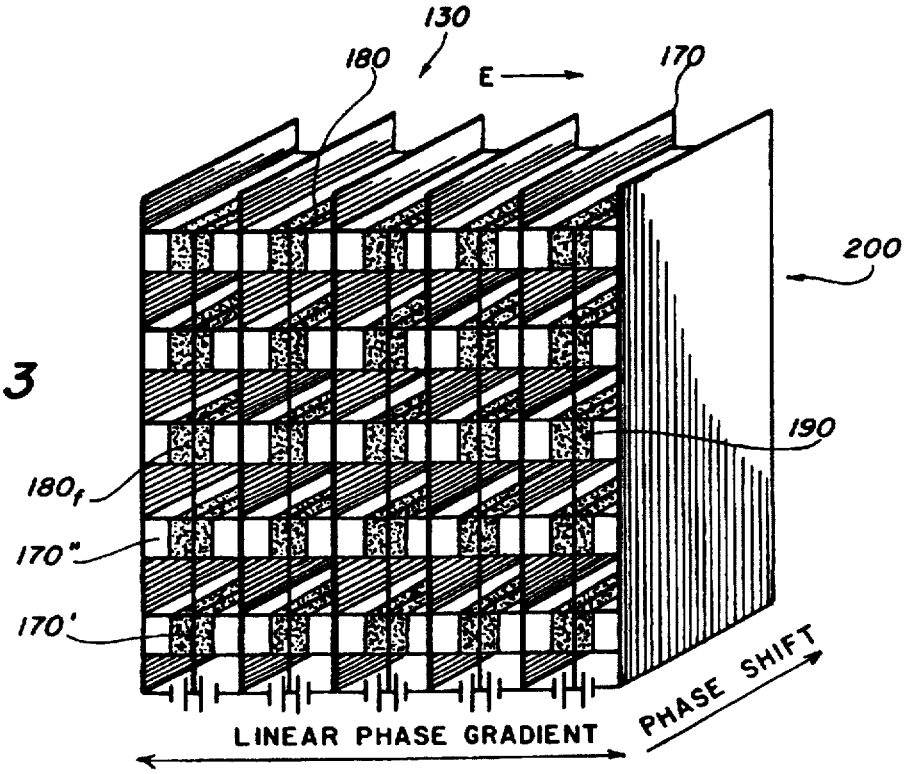
FIG. 3 shows in three-dimensional view a configuration for the lens of FIG. 1.

Referring now to FIG. 3, in this configuration of a lens 130, the slab 180 is not necessarily completely filled with ferroelectric material $\mathbf{180}_f$. By using lighter material, such as air as a filler, the weight of the lens 130 can be reduced. Furthermore, if the ferroelectric material $\mathbf{180}_f$ does not extend all the way to each edge of the conducing plate 170 as in the "ridge" configuration shown, the amount of applied voltage necessary to produce a desired electric field intensity in the slab 180 can be reduced. As with FIG. 2, the receiving face 190 is the exposed face and the radiating face 200 is hidden from view.

A further and independent refinement of lens 130 relates to the manner in which voltage is applied to the ferroelectric material $\mathbf{180}_f$ in the slabs 180. The ferroelectric material $\mathbf{180}_f$ is bifurcated with an additional conductive plate 170' in between. There are now two types of conductive plate 170: the adjacent plate 170" and the additional plate 170'. The control voltage is applied between this additional conducting plate 170' (recessed with respect to the adjacent plate 170") and the adjacent plate 170". Since the ferroelectric material $\mathbf{180}_f$ in slab 180 is bifurcated, only half the control voltage needs to be applied to produce the same field intensity in the ferroelectric material $\mathbf{180}_f$. Furthermore, the polarity of applied control voltage across each slab section is alternated, since the polarity of electric field across the slab section is irrelevant to the ferroelectric effect. The adjacent plates 170" are preferably at or close to ground, thus making the handling of lens 130 safer.

Figure 4:
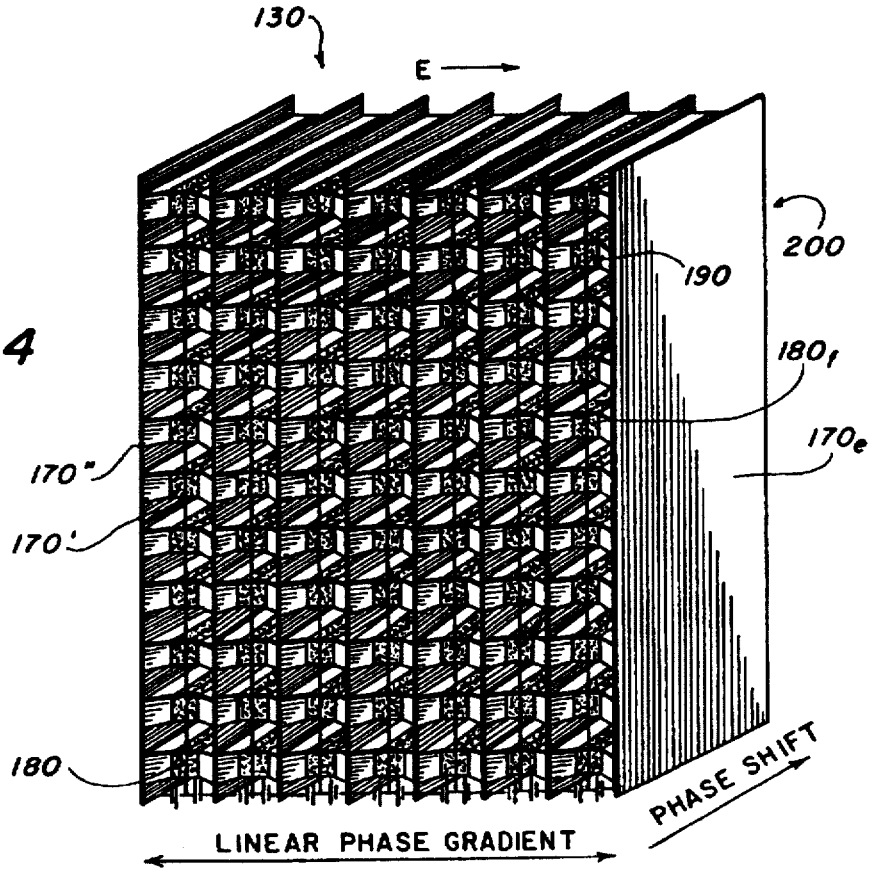
FIG. 4 shows in three-dimensional view a configuration for the lens of FIG. 1.

Referring now to FIG. 4, a lens 130 is shown in which the ferroelectric material $\mathbf{180}_f$ in the slab 180 is recessed on all four edges from the adjacent plate 170" and the plate 170" makes tapered contact with the ferroelectric material $\mathbf{180}_f$. This configuration provides good impedance matching to improve coupling of the incident signal to the lens 130 and of the radiated signal to free space. As with FIGS. 2 and 3, the receiving face 190 is the exposed face and the radiating face 200 is hidden from view.

Figure 5:
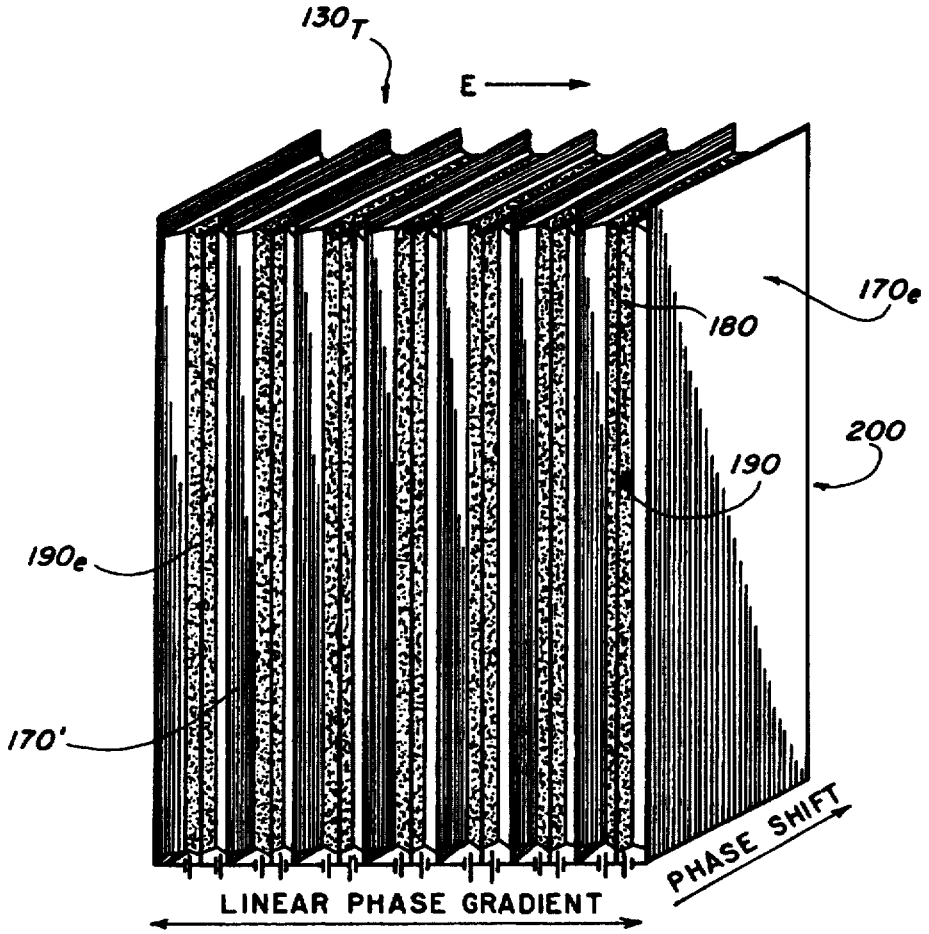
FIG. 5 is a three-dimensional view of a tapered configuration of the lens of FIG. 1.
Figure 6:
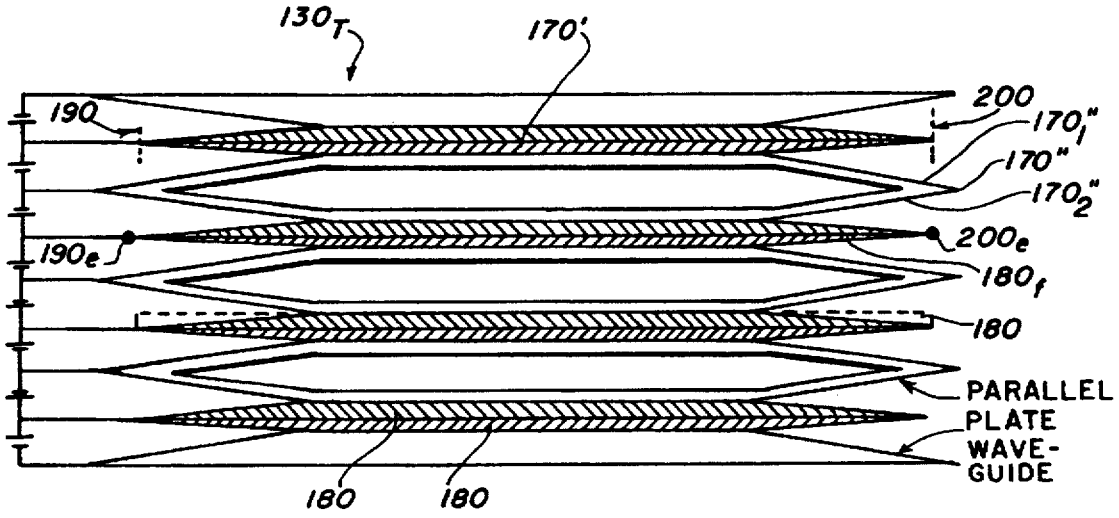
FIG. 6 is a cross-sectional view in the scanning plane of the lens of FIG. 5.

Referring now to FIGS. 5 and 6, in a tapered lens $\mathbf{130}_T$, the slab 180 is substantially filled with ferroelectric material $\mathbf{180}_f$. The ferroelectric material $\mathbf{180}_f$ is tapered to a line $\mathbf{190}_i$ and $\mathbf{200}_i$ on both the receiving and radiating surfaces 190 and 200, respectively. As with the lens 130 of FIG. 3, the ferroelectric material $\mathbf{180}_f$ is optionally bifurcated with an additional conductive plate 170' in between. The control voltage is applied between this additional conducting plate 170' (recessed with respect to the adjacent plate 170") and the adjacent plate 170". The polarity of applied control voltage across each slab section is alternated, and adjacent plates 170" are preferably at or close to ground.

The adjacent plate 170" is now also bifurcated to form conductive plates $\mathbf{170}_1$" and $\mathbf{170}_2$" as shown in FIG. 6. Plates $\mathbf{170}_1$" and $\mathbf{170}_2$" are parallel throughout most of the lens $\mathbf{130}_T$ but are tapered to a line between the receiving and radiating surfaces 190 and 200, respectively, of the slab 180. The space between plates $\mathbf{170}_1$" and $\mathbf{170}_2$" is filled with air or similar material with relative dielectric constant $\epsilon$ of about 1. This space could be used for cooling, such as by using forced air or providing ventilation. The slab 180 is still substantially a rectangular solid and the receiving and radiating surfaces 190 and 200 respectively are still perpendicular to the parallel part of plates $\mathbf{170}_1$" and $\mathbf{170}_2$" and to the scanning plane, but do not necessarily define a boundary of the ferroelectric material $\mathbf{180}_f$.

The ferroelectric material $\mathbf{180}_f$ fills the space between plates $\mathbf{170}_1$" and 170', and the space between plates 170' and $\mathbf{170}_2$" in the parallel part of plates $\mathbf{170}_1$" and $\mathbf{170}_2$". The distance between plates $\mathbf{170}_1$" and 170', and the distance between plates 170' and $\mathbf{170}_2$" in the parallel part of plates $\mathbf{170}_1$" and $\mathbf{170}_2$" can be made smaller than $\lambda_0/2$. Since the relative dielectric constant $\epsilon$ is much greater than 1, $\lambda_0/2$ is much greater than $\lambda/2$, and the above-described distance can be made smaller than $\lambda_0/2$ so as to be at most approximately $\lambda/2$, thus avoiding complications due to higher order modes.

Figure 7:
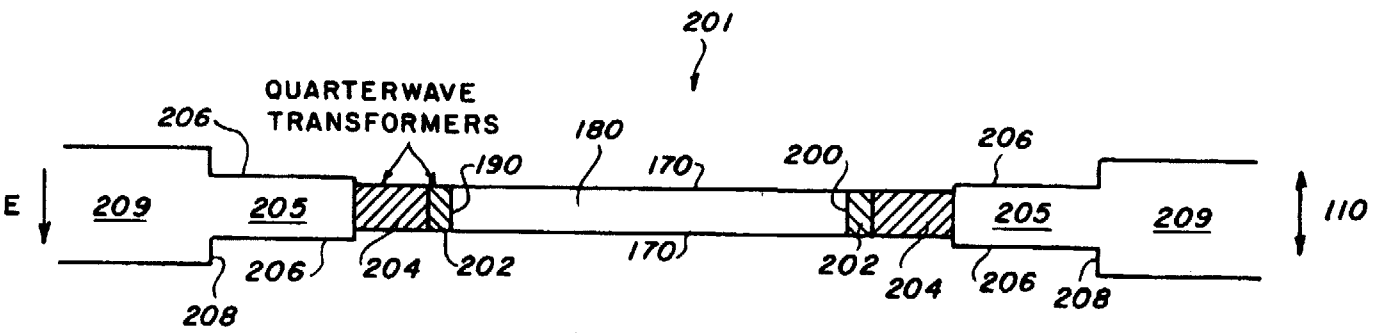
FIG. 7 is a cross-sectional view in the scanning plane of a device of FIG. 1 using steps and quarter-wave transformers for impedance matching.

Referring now to FIG. 7, a device 201 includes quarter-wave transformers 202 and 204 and steps 208 for impedance matching. The receiving and radiating faces 190 and 200 of the slab 180, filled with ferroelectric material $\mathbf{180}_f$, having exemplary relative dielectric constant $\epsilon$ of 100, are each coupled to a pair of quarter wave transformers 202 and 204 of width $\lambda/4$. The quarter wave transformer 202 coupled directly to the slab 180 has exemplary relative dielectric constant $\epsilon$ of 30, and the quarter wave transformer 204 coupled to the quarter wave transformer 202 has exemplary relative dielectric constant $\epsilon$ of 2.55. The quarter wave transformer 204 is coupled to a section of free space 205 blocked by parallel conductive plates 206 conductively coupled to the parallel plates 170. The free space section 205 has a step 208 at a distance $\lambda_0/4$ from the quarter wave transformer 204. On the input side, the step 208 is between the first section of free space 205 and a second section of free space 209 which is responsive to an electromagnetic signal having an electrical component parallel to the scanning axis 110. The output side is comparable to the input side but not necessarily precisely symmetrical. Other combinations of quarter wave transformers and/or steps for impedance matching may be readily designed by a person of ordinary skill in the art. The device 100 (FIG. 1) includes a periodic array of such devices 201. Just as with the configurations shown in FIGS. 4, 5 and 6, the slab 180 of FIG. 7 can be bifurcated.

The above-described lens 130 for scanning in one plane can be cascade coupled with another device for scanning in a different plane so as to provide three-dimensional scanning.

Figure 8:
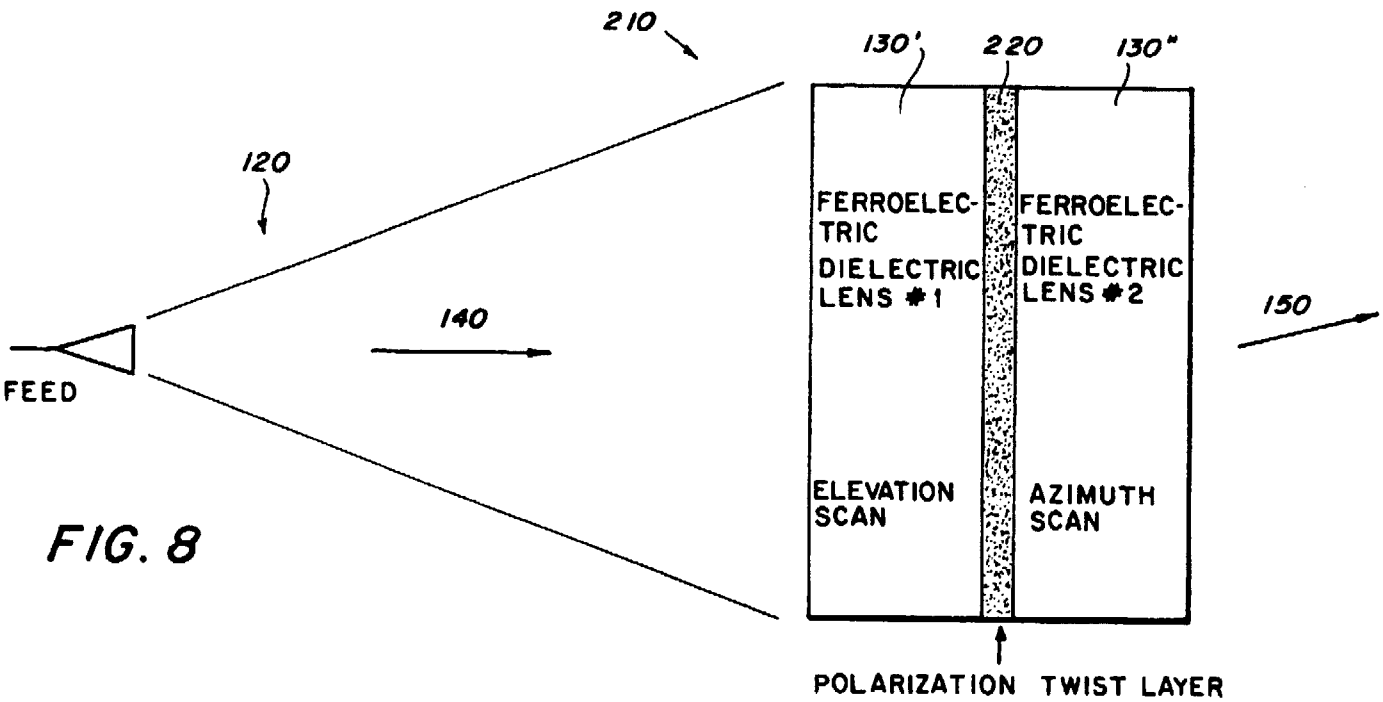
FIG. 8 shows a device for three-dimensional scanning in two scanning planes.

Referring now to FIG. 8, a device 210 using bulk phase shifting includes a space feed system 120 for providing an electromagnetic signal, preferably having a spherical wavefront in propagation direction 140 to a first lens system 130' as described above for scanning in a first scanning plane, such as a vertical scan. The first lens system 130' is thus for elevational scanning. The output of the first lens system 130' is provided to a 90° linear polarization rotator 220, also called a polarization twist layer 220. The polarization twist layer 220 rotates the plane of polarization of the electromagnetic signal output by the first lens system 130' for input to a second lens system 130". The second lens system 130" is as described above for scanning in a second plane, such as the horizontal plane. The second lens system 130" is thus for azimuthal scanning. The polarization twist layer 220 provides an electromagnetic signal to the second lens system 130" with an electrical field component in the horizontal direction. The second lens system 130" and output means outputs an electromagnetic signal in selected propagation direction 150. The direction of propagation of outputted electromagnetic signal may very well be into or out of the plane of FIG. 8.

The three-dimensional scanning system 210 may be thought of as the scanning system 100 of FIG. 1 in which the feed system 120 with a simple horn feed, the first lens 130' and the polarization twist layer 220 provides an input electromagnetic signal to lens 130". A more complicated line feed or planar array could also be used. Alternatively, the three-dimensional scanning system 210 may be thought of as the scanning system 100 of FIG. 1 in which the feed system 120 provides an input electromagnetic signal to lens 130', and the polarization twist layer 220 and the second lens 130" process the output electromagnetic signal from the first lens 130'.

The above-described system 210 provides three-dimensional scanning with the same low cost advantages as the two-dimensional scanning system 130 discussed above. The device 210 so described uses bulk phase shifting lenses 130' and 130" for scanning in two scanning planes. It uses simple phase shifting devices: ferroelectric slabs 180 sandwiched between conductive plates 170, simple steering control: application of control voltages $V_1, V_2, \ldots, V_n$, and simple feed: space feed. Furthermore, if the first lens 130' has n slabs and the second lens has m slabs, then the beam steering control circuitry need only provide n+m drivers, in contrast to conventional three-dimensional scanners which use n×m drivers. For a 100×100 array, the present system uses 200 drivers, as opposed to 100,000 drivers for prior art phased array antennas. This invention thus provides simple steering control and fewer phase shifting devices at considerable savings.

Figure 9:
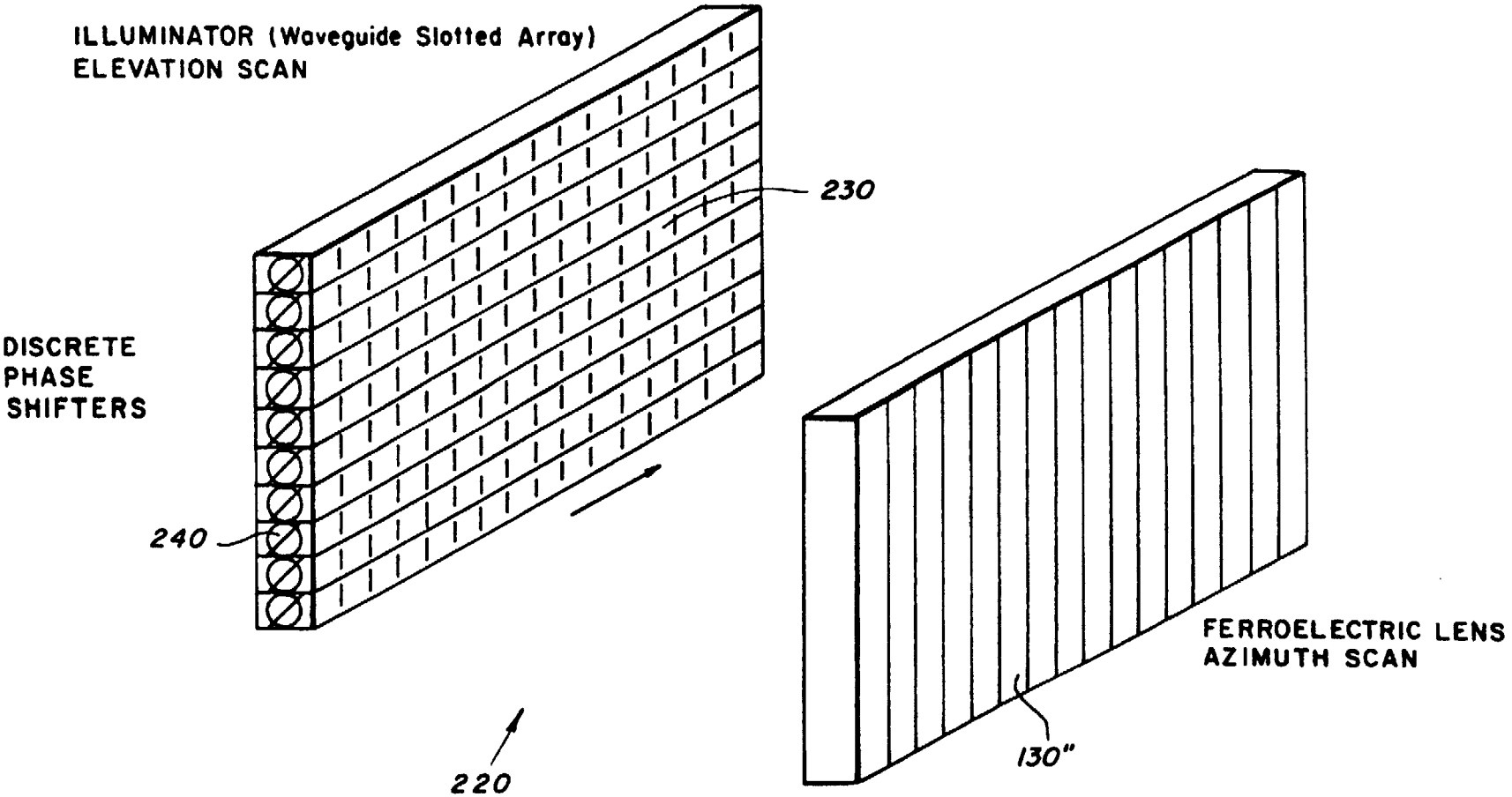
FIG. 9 shows in three-dimensional view a device for three-dimensional scanning in two scanning planes.

Referring now to FIG. 1, the device 100 may be made into a three-dimensional scanning system 220 for scanning in 2 planes as shown in FIG. 9. In such a system, a planar array, such as a slotted waveguide array 230, provides elevational scanning by use of a separate and discrete phase shifter 240 for each row. An example of this type of array is the AN/TPQ-36 built by Hughes Aircraft Co. The planar array 230 outputs an electromagnetic signal with horizonal electric field to feed lens 130" and is comparable to the feed system 120 shown in FIG. 1. Lens 130" as described above provides azimuthal scanning.

Figure 10:
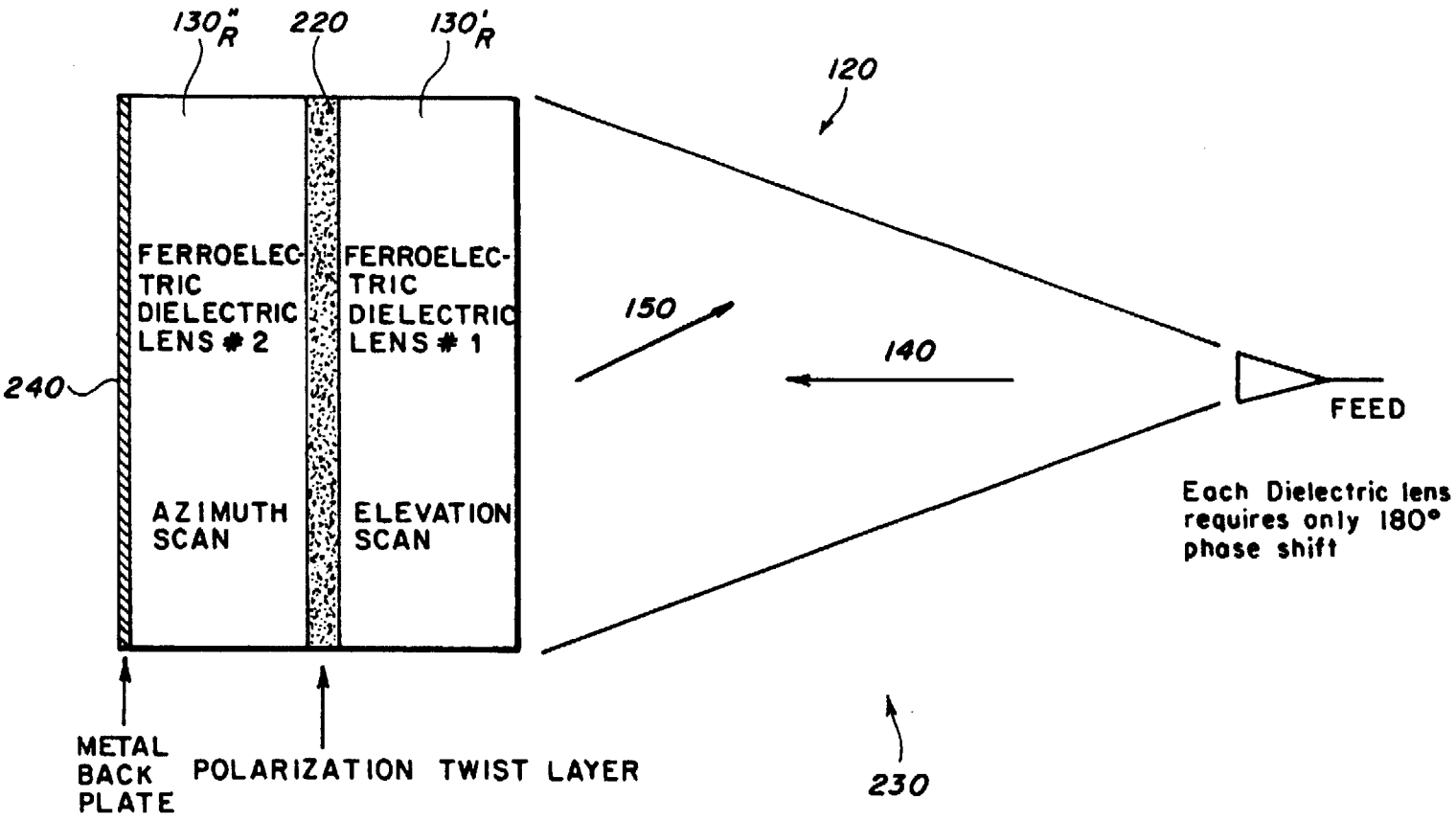
FIG. 10 shows a reflectarray device for three-dimensional scanning in two scanning planes.

Cascaded ferroelectric lenses could be used with a reflector as a reflectarray for two or three-dimensional scanning. Referring now to FIG. 10, a device 230 using bulk phase shifting includes a space feed system 120 for providing an electromagnetic signal in propagation direction 140 to a first lens system $\mathbf{130}_R$' for scanning in a first scanning plane, such as a vertical scan. The first lens system $\mathbf{130}_R$' is thus for elevational scanning. The output of the first lens system $\mathbf{130}_R$' is provided to a polarization twist layer 220 which rotates the plane of polarization of the electromagnetic signal output by the first lens system $\mathbf{130}_R$' for input to a second lens system $\mathbf{130}_R$". The second lens system $\mathbf{130}_R$" is for scanning in a second plane, such as the horizontal plane. The second lens system $\mathbf{130}_R$" is thus for azimuthal scanning. The first and second lens systems $\mathbf{130}_R$' and $\mathbf{130}_R$", respectively, are as described above for lens 130 except that they each need only alter the phase by up to π radians (180°), not 2π radians (360°), and can be half the thickness of the lens 130 discussed above, that is, $\lambda_0/2$, not $\lambda_0$. The polarization twist layer 220 provides an electromagnetic signal to the second lens system $\mathbf{130}_R$" with an electrical field component in the horizontal direction.

The reflectarray device 230 also includes a metal or other conductive back plate 240 disposed on the opposite side of the second lens $\mathbf{130}_R$" from the phase twisting layer 220 for reflecting the signal back through the second lens $\mathbf{130}_R$", the phase twisting layer 220, and the first lens $\mathbf{130}_R$' for output in selectively controlled propagation direction 150. The direction of propagation 150 of the outputted electromagnetic signal may very well be into or out of the plane of FIG. 10. The reflectarray device 230 thus provides three-dimensional elevational and azimuthal scanning. The reflectarray device 230 has all of the above-described advantages of the device 210. In addition, it can be thinner and lighter.

The foregoing descriptions of the preferred embodiments are intended to be illustrative and not limiting. It will be appreciated that numerous modifications and variations can be made without departing from the spirit or scope of the present invention.

What is claimed is:

1. A device for scanning in a scanning axis in a scanning plane, said device comprising:

(a) a periodic array of conductive plates disposed along the scanning axis, each conductive plate being substantially rectangular and substantially perpendicular to the scanning axis, adjacent plates being disposed about half a wavelength apart;

(b) a periodic array of slabs disposed along the scanning axis, each slab comprising ferroelectric material, being disposed between a pair of adjacent conductive plates of said periodic array of conductive plates, adjacent slabs being separated by one of said conductive plates, each of said slabs having a receiving face and a radiating faces substantially parallel to each other, each of said slabs being for transmission of an electromagnetic signal from said receiving face to said radiating face responsive to an electromagnetic signal received at said receiving face, and each of said radiating faces, scanning plane, and said conductive plates being substantially mutually perpendicular;

(c) input transmission means for feeding an input electromagnetic signal to said periodic array of slabs in a propagation direction so that the input electromagnetic signal is incident on the receiving faces of each of said slabs and so that the electrical component of the input electromagnetic signal received at each receiving face has a component parallel to the scanning axis;

(d) output transmission means for transmitting an output signal from said periodic array of slabs responsive to the electromagnetic signal transmitted from each receiving face in said corresponding slab and received at the corresponding radiating face; and (e) a plurality of means for selectively applying a voltage across each of said pairs of conductive plates disposed about a slab so as to selectively control the phase of the electromagnetic signal received at each of said radiating faces having been transmitted from said receiving face in said corresponding slab.

2. The device of claim 1 for three-dimensional scanning, said input transmission means (c) comprising a planar array for scanning in a first scanning axis in a first scanning plane, and said elements (a), (b), (d) and (e) being for scanning in a second scanning axis in a second scanning plane.

3. A device for three-dimensional scanning in a first scanning axis in a first scanning plane and in a second scanning axis in a second scanning plane, said device comprising:

(a) a first and second lens, the first lens being for two-dimensional scanning in the first scanning axis in the first scanning plane and the second lens being for two-dimensional scanning in the second scanning axis in the second scanning plane, each lens comprising:

(i) a periodic array of conductive plates disposed along the corresponding scanning axis, each conductive plate being substantially rectangular and substantially perpendicular to the corresponding scanning axis, adjacent plates being disposed about half a wavelength apart; and (ii) a periodic array of slabs disposed along the corresponding scanning axis, each slab comprising ferroelectric material, being disposed between a pair of adjacent conductive plates of said periodic array of conductive plates, adjacent slabs being separated by one of said conductive plates, each of said slabs having a receiving face and a radiating faces substantially parallel to each other, each of said slabs being for transmission of an electromagnetic signal from said receiving face to said radiating face responsive to an electromagnetic signal received at said receiving face, and each of said radiating faces, corresponding scanning plane, and said conductive plates being substantially mutually perpendicular;

(b) input transmission means for feeding an input electromagnetic signal to said periodic array of slabs of said first lens in a propagation direction so that the input electromagnetic signal is incident on the receiving faces of each of said slabs and so that the electrical component of the input electromagnetic signal received at each receiving face has a component parallel to the first scanning axis;

(c) intermediate transmission means for transmitting an output signal from said periodic array of slabs of said first lens responsive to the electromagnetic signal transmitted from each receiving face in said corresponding slab and received at the corresponding radiating face to said periodic array of slabs of said second lens in a propagation direction so that the input electromagnetic signal is incident on the receiving faces of each of said slabs and so that the electrical component of the input electromagnetic signal received at each receiving face has a component parallel to the second scanning axis;

(d) output transmission means for transmitting an output signal from said periodic array of slabs of said second lens responsive to the electromagnetic signal transmitted from each receiving face in said corresponding slab and received at the corresponding radiating face; and (e) a plurality of means for selectively applying a voltage across each of said pairs of conductive plates disposed about a slab of each of said first and second lenses so as to selectively control the phase of the electromagnetic signal received at each of said radiating faces having been transmitted from said receiving face in said corresponding slab.

4. A device for three-dimensional scanning in a first scanning axis in a first scanning plane and in a second scanning axis in a second scanning plane, said device comprising:

(a) a first and second lens, the first lens being for two-dimensional scanning in the first scanning axis in the first scanning plane and the second lens being for two-dimensional scanning in the second scanning axis in the second scanning plane, each lens comprising:

(i) a periodic array of conductive plates disposed along the corresponding scanning axis, each conductive plate being substantially rectangular and substantially perpendicular to the corresponding scanning axis, adjacent plates being disposed about half a wavelength apart; and (ii) a periodic array of slabs disposed along the corresponding scanning axis, each slab comprising ferroelectric material, being disposed between a pair of adjacent conductive plates of said periodic array of conductive plates, adjacent slabs being separated by one of said conductive plates, each of said slabs having a receiving face and a radiating faces substantially parallel to each other, each of said slabs being for transmission of an electromagnetic signal from said receiving face to said radiating face responsive to an electromagnetic signal received at said receiving face and for transmission of an electromagnetic signal from said radiating face to said receiving face responsive to an electromagnetic signal received at said radiating face, and each of said radiating faces, corresponding scanning plane, and said conductive plates being substantially mutually perpendicular;

(b) input transmission means for feeding an input electromagnetic signal to said periodic array of slabs of said first lens in a propagation direction so that the input electromagnetic signal is incident on the receiving faces of each of said slabs and so that the electrical component of the input electromagnetic signal received at each receiving face has a component parallel to the first scanning axis;

(c) first intermediate transmission means for transmitting an output signal from said periodic array of slabs of said first lens responsive to the electromagnetic signal transmitted from each receiving face in said corresponding slab and received at the corresponding radiating face to said periodic array of slabs of said second lens in a propagation direction so that the input electromagnetic signal is incident on the receiving faces of each of said slabs and so that the electrical component of the input electromagnetic signal received at each receiving face has a component parallel to the second scanning axis;

(d) a reflector coupled to said second lens for returning said signal transmitted from each receiving face in said corresponding slab of said second lens and received at the corresponding radiating face to said radiating face in opposite direction;

(e) second intermediate transmission means for transmitting an output signal from said periodic array of slabs of said second responsive to the electromagnetic signal transmitted from each radiating face in said corresponding slab and received at the corresponding receiving face to said periodic array of slabs of said first lens in a propagation direction so that the input electromagnetic signal is incident on the radiating faces of each of said slabs of said first lens and so that the electrical component of the input electromagnetic signal received at each radiating face has a component parallel to the first scanning axis;

(f) output transmission means for transmitting an output signal from said periodic array of slabs of said first lens responsive to the electromagnetic signal transmitted from each radiating face in said corresponding slab and received at the corresponding receiving face; and (g) a plurality of means for selectively applying a voltage across each of said pairs of conductive plates disposed about a slab of each of said first and second lenses so as to selectively control the phase of the electromagnetic signal received at each of said radiating faces having been transmitted from said receiving face in said corresponding slab and received at each of said receiving faces having been transmitted from said radiating face in said corresponding slab.

* * * * *